US009774935B2

(12) United States Patent
Matsumura et al.

(10) Patent No.: US 9,774,935 B2
(45) Date of Patent: Sep. 26, 2017

(54) SPEAKER DEVICE

(71) Applicant: Panasonic Intellectual Property Management Co., Ltd., Osaka (JP)

(72) Inventors: Toshiyuki Matsumura, Osaka (JP); Akihisa Kawamura, Osaka (JP); Kazuki Honda, Osaka (JP); Takafumi Yuasa, Osaka (JP); Shuji Saiki, Nara (JP); Satoshi Takayama, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/246,958

(22) Filed: Aug. 25, 2016

(65) Prior Publication Data

US 2017/0064421 A1 Mar. 2, 2017

Related U.S. Application Data

(60) Provisional application No. 62/212,746, filed on Sep. 1, 2015.

(30) Foreign Application Priority Data

May 25, 2016 (JP) ..... 2016-104538

(51) Int. Cl.
*H04R 1/02* (2006.01)
*H04R 1/40* (2006.01)
(Continued)

(52) U.S. Cl.
CPC ..... *H04R 1/025* (2013.01); *H04R 1/403* (2013.01); *H04R 7/127* (2013.01); *H04R 7/18* (2013.01);
(Continued)

(58) Field of Classification Search
CPC ..... H04R 1/025; H04R 1/403; H04R 7/127; H04R 7/18; H04R 9/025; H04R 9/046; H04R 9/06
(Continued)

(56) References Cited

U.S. PATENT DOCUMENTS 5,253,301 A * 10/1993 Sakamoto ..... H04R 1/2826 181/145

FOREIGN PATENT DOCUMENTS

JP 11-178085 7/1999

* cited by examiner

*Primary Examiner* — David Ton
(74) *Attorney, Agent, or Firm* — Greenblum & Bernstein, P.L.C.

(57) ABSTRACT

A speaker device for reproducing an audio signal includes a first speaker including a first diaphragm and a first magnetic circuit that drives the first diaphragm, where the first diaphragm reproduces an audio signal including a predetermined frequency range, a second speaker including a second diaphragm and a second magnetic circuit that drives the second diaphragm, where the second diaphragm reproduces an audio signal including a frequency range substantially the same as the predetermined frequency range, and at least one cabinet having the first speaker and the second speaker mounted therein so that radiation directions of sounds are opposite to each other. At least part of a space formed between the first speaker and the second speaker communicates with the outside of the cabinet. When the speaker device reproduces the audio signal, the first diaphragm and the second diaphragm vibrate in opposite directions.

10 Claims, 13 Drawing Sheets

(51) Int. Cl.

| | |
|---|---|
| ***H04R 7/18*** | (2006.01) |
| ***H04R 9/02*** | (2006.01) |
| ***H04R 9/06*** | (2006.01) |
| ***H04R 7/12*** | (2006.01) |
| ***H04R 9/04*** | (2006.01) |

(52) U.S. Cl.
CPC ..... *H04R 9/025* (2013.01); *H04R 9/046* (2013.01); *H04R 9/06* (2013.01)

(58) Field of Classification Search
USPC ... 381/86, 87, 335, 351, 352, 160, 163, 186, 381/412
See application file for complete search history.

SPEAKER DEVICE

BACKGROUND

1. Technical Field

The present disclosure relates to a speaker device and a vehicle and an AV equipment each including the speaker device.

2. Description of the Related Art

A speaker device is mounted in, for example, a vehicle, AV equipment, a mobile object, or a building. In recent years, demand for reduction in size of a speaker device and a small occupied area of the speaker device has grown. At the same time, demand for high power and wide-range frequency in playback from the small body with low-distortion sound has grown.

In general, if the size of a speaker device is reduced, it is difficult to ensure sufficient sizes of members that support a drive system (e.g., the edge and the dumper) due to the size limitation. Accordingly, the supporting forces of the diaphragms become asymmetrical with respect to the position of the diaphragm having a displacement of zero. Note that the phrase "position of the diaphragm having a displacement of zero" refers to the position of the diaphragm when no drive signal is input to the speaker device. In addition, due to the thickness limitation, the drive forces of the diaphragms may become asymmetrical with respect to the position of the diaphragm having a displacement of zero. The asymmetry property of the diaphragm supporting forces and diaphragm drive forces causes distortion of the playback sound and, thus, prevents the speaker device from being reduced in size and producing high power.

In addition, a speaker device for reducing distortion of the playback sound caused by the asymmetry property of the diaphragm supporting forces and diaphragm drive forces of the speakers and simultaneously reducing vibration of a cabinet has been developed (refer to, for example, Japanese Unexamined Patent Application Publication No. 11-178085).

FIG. 10 illustrates the configuration of an existing speaker device (a speaker device described in Japanese Unexamined Patent Application Publication No. 11-178085). As illustrated in FIG. 10, a speaker device 80 includes a first speaker unit 83 and a second speaker unit 84 fixed to a first opening 85*a* and a second opening 85*b*, respectively, and a connection member 86 that connects a first speaker frame 87 to a second speaker frame 88. As a result, vibrations generated by the vibrating diaphragms of the first speaker unit 83 and the second speaker unit 84 are canceled out and, thus, the vibrations of the first speaker unit 83, the second speaker unit 84, and a cabinet 82 can be prevented. In addition, the sum of the drive forces of the diaphragms of the speakers is symmetrical with respect to the stationary position of the diaphragm located during no input and, thus, the second-order distortion of the speaker can be significantly reduced.

SUMMARY

However, according to the configuration of the existing speaker device illustrated in FIG. 10, the distance between the first opening 85*a* and the second opening 85*b* is long. Accordingly, a path length difference between the sounds played back by the first speaker unit 83 and the second speaker unit 84 is large. Thus, the phase interference occurs, and the quality of playback sound is degraded.

One non-limiting and exemplary embodiment provides a speaker device including a plurality of speaker units and capable of reducing the degradation of the quality of playback sound.

In one general aspect, the techniques disclosed here feature a speaker device for reproducing an audio signal. The speaker device includes a first speaker unit including a first diaphragm and a first magnetic circuit that drives the first diaphragm, where the first diaphragm reproduces an audio signal including a predetermined frequency range, a second speaker unit including a second diaphragm and a second magnetic circuit that drives the second diaphragm, where the second diaphragm reproduces an audio signal including a frequency range substantially the same as the predetermined frequency range, and at least one cabinet having the first speaker unit and the second speaker unit mounted therein so that radiation directions of sounds are opposite to each other. At least part of a space formed between the first speaker unit and the second speaker unit communicates with the outside of the cabinet. When the audio signal is reproduced by the speaker device, the first diaphragm and the second diaphragm vibrate in opposite directions.

According to the present disclosure, a speaker device including a plurality of speaker units and capable of reducing degradation of the quality of playback sound can be provided.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
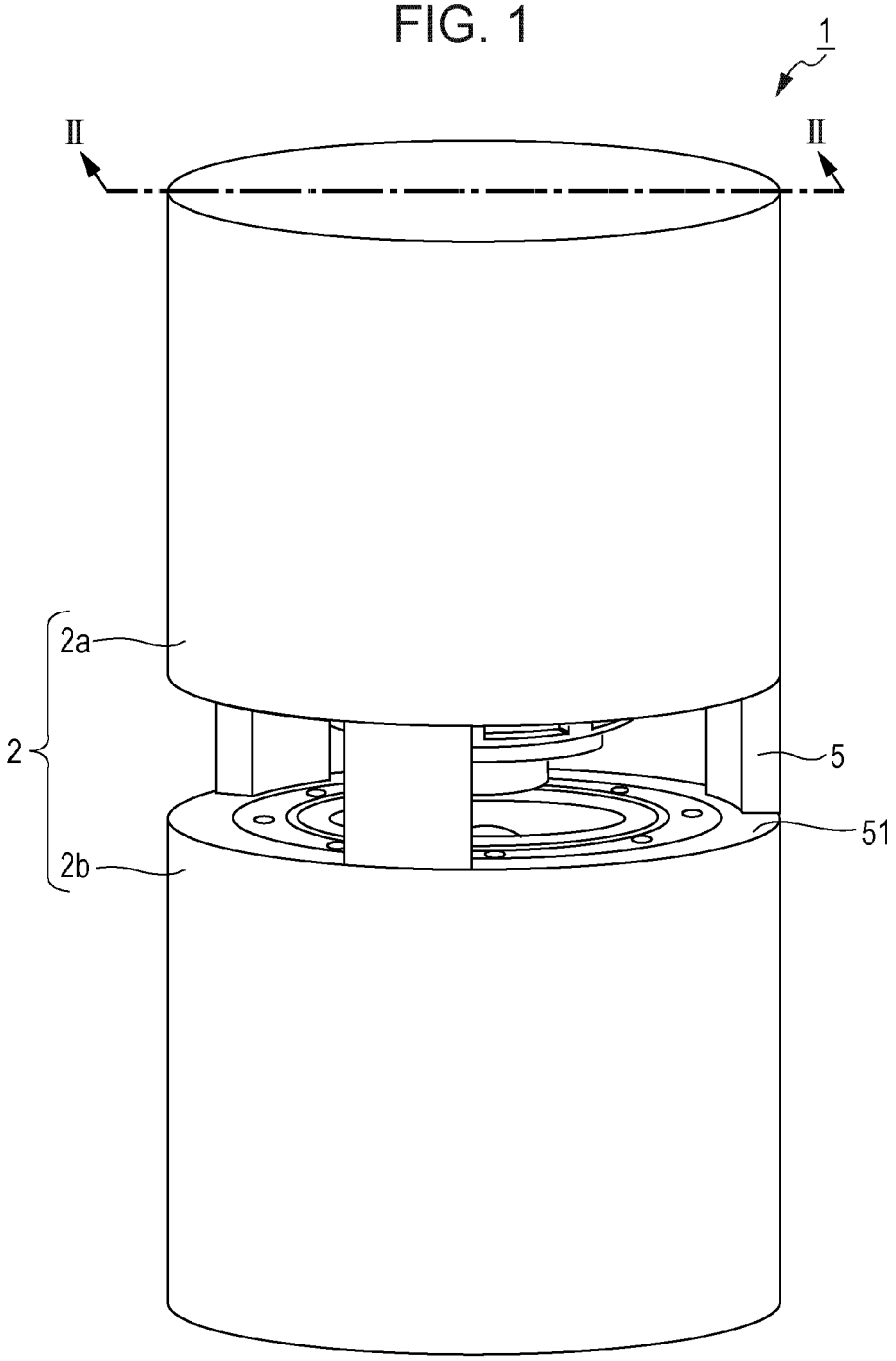
FIG. 1 illustrates an example of an external view of a speaker device according to a first exemplary embodiment.

According to an aspect of the present disclosure, a speaker device for reproducing an audio signal is provided. The speaker device includes a first speaker unit including a first diaphragm and a first magnetic circuit that drives the first diaphragm, where the first diaphragm reproduces an audio signal including a predetermined frequency range, a second speaker unit including a second diaphragm and a second magnetic circuit that drives the second diaphragm, where the second diaphragm reproduces an audio signal including a frequency range substantially the same as the predetermined frequency range, and at least one cabinet having the first speaker unit and the second speaker unit mounted therein so that radiation directions of sounds are opposite to each other. At least part of a space formed between the first speaker unit and the second speaker unit communicates with the outside of the cabinet. When the audio signal is reproduced by the speaker device, the first diaphragm and the second diaphragm vibrate in opposite directions. Such a configuration can prevent a decrease in the quality of produced sound while including a plurality of speaker units.

More specifically, the path length difference between the sounds from a first speaker unit and a second speaker unit can be reduced and, thus, the phase interference can be prevented. As a result, a decrease in the quality of produced sound can be prevented.

In addition, all the following disadvantages can be eliminated at the same time: the asymmetry between the air expulsion volumes of the edges of the first speaker unit and the second speaker unit, distortion of the playback sound occurring due to the drive force of the diaphragm, and the vibration of the cabinet caused by the vibration of the first and second speaker units.

In addition, for example, when the audio signal is reproduced by the speaker device and if the first diaphragm operates to move closer to the first magnetic circuit, the second diaphragm operates to move away from the second magnetic circuit. In contrast, if the first diaphragm operates to move away from the first magnetic circuit, the second diaphragm operates to move closer to the second magnetic circuit.

In addition, for example, the first speaker unit may include a first edge that supports the first diaphragm for vibration, and the second speaker unit may include a second edge that supports the second diaphragm for vibration. A cross-sectional shape of the first edge may be convex in a direction from the space toward the first speaker unit, and a cross-sectional shape of the second edge may be convex in a direction from the second speaker unit toward the space.

In addition, for example, the speaker device may further include a diffuser plate that is located in the space at a position facing at least one of the first diaphragm and the second diaphragm, where the diffuser plate scatters playback sound output from the speaker device.

In addition, for example, the cabinet may be formed from a plurality of cabinets, and the plurality of cabinets may be mechanically joined together.

In addition, for example, the speaker device may further include a communication tube that acoustically joins the plurality of cabinets together.

In addition, for example, when the audio signal is reproduced by the speaker device, the first diaphragm and the second diaphragm may vibrate in opposite directions by connecting a negative polarity and a positive polarity of an audio signal voltage to a positive terminal and a negative terminal of one of the first speaker unit and the second speaker unit, respectively, and connecting the positive polarity and the negative polarity of the audio signal voltage to a positive terminal and a negative terminal of the other of the first speaker unit and the second speaker unit, respectively.

In addition, for example, the first speaker unit may include at least one first voice coil bobbin and a first voice coil formed by winding a wire around an outer circumferential surface of a substantially middle portion of the first voice coil bobbin in a height direction to transfer vibration to the first diaphragm. The second speaker unit may include at least one second voice coil bobbin and a second voice coil formed by winding a wire around an outer circumferential surface of a substantially middle portion of the second voice coil bobbin in a height direction to transfer vibration to the second diaphragm. The winding directions of the first voice coil and the second voice coil may be opposite to each other.

In addition, for example, the first magnetic circuit may include a first magnet, and the second magnetic circuit may include a second magnet, and the magnetization directions of the first magnet and the second magnet may be opposite to each other.

Note that each of the embodiments described below is a particular example of the present disclosure. A value, a shape, a constituent element, and the sequence of steps used in the embodiments are only examples and shall not be construed as limiting the scope of the present disclosure. In addition, among the constituent elements in the embodiments described below, the constituent element that does not appear in an independent claim, which has the broadest scope, is described as an optional constituent element. In addition, all the embodiments may be combined in any way. Speaker devices according to an aspect of the present disclosure are described below with reference to the accompanying drawings.

First Exemplary Embodiment

Configuration of Speaker Device

Figure 2:
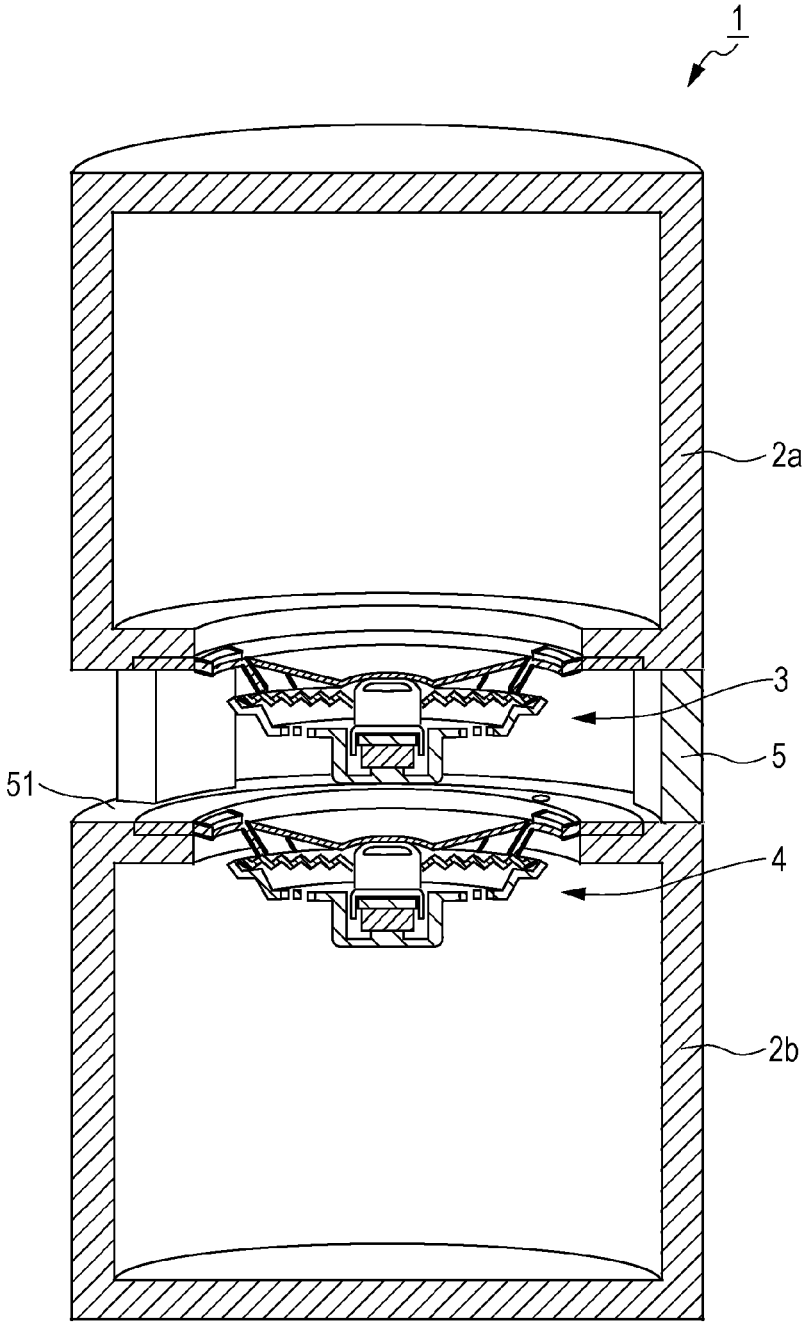
FIG. 2 is a cross-sectional view taken along a line II-II of FIG. 1.
Figure 3A:
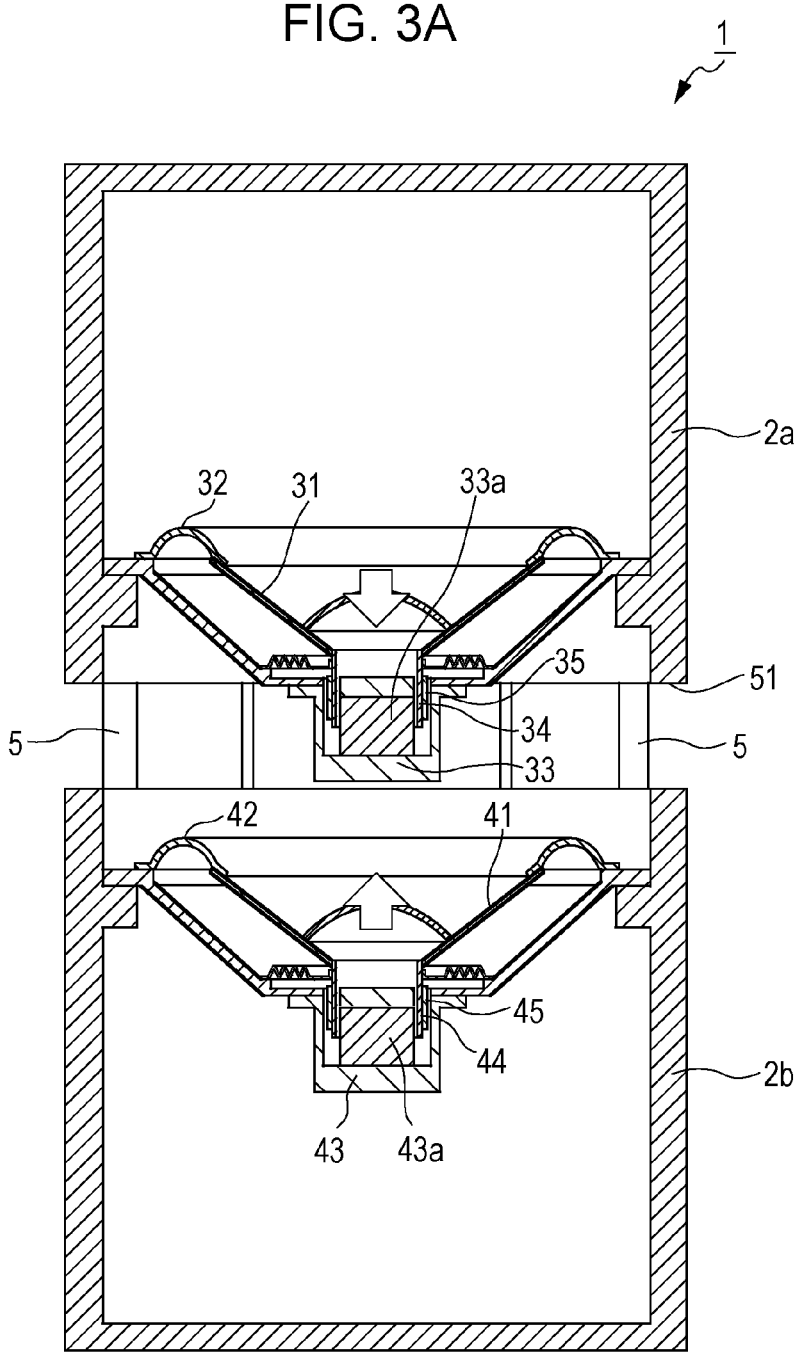
FIG. 3A is an example of the cross-sectional structure diagram of the speaker device according to the first exemplary embodiment.
Figure 3B:
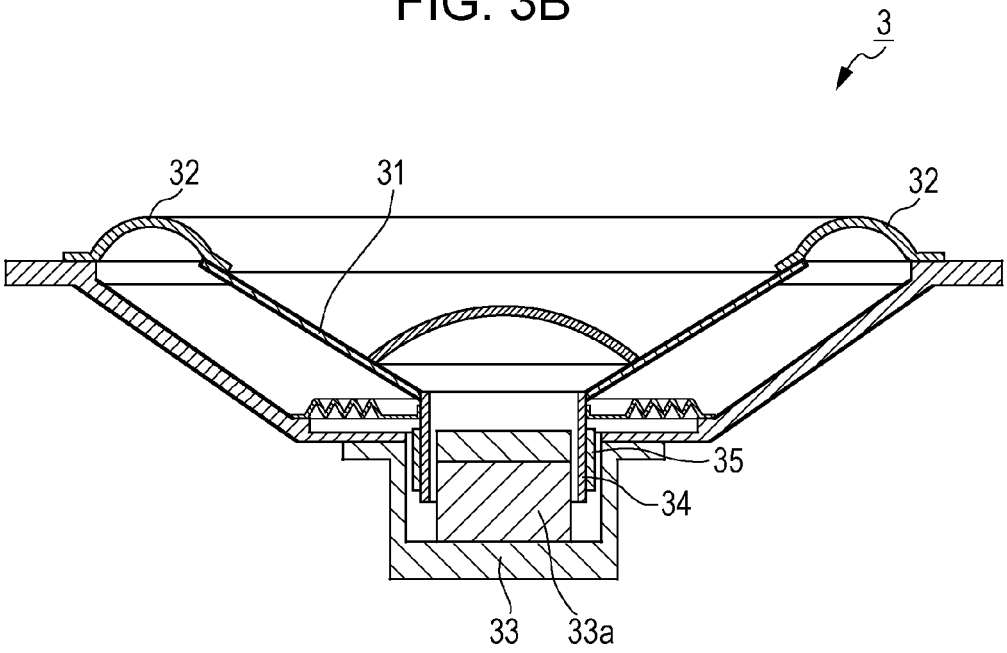
FIG. 3B is a detailed cross-sectional structure diagram of a first speaker unit illustrated in FIG. 3A.

FIG. 1 illustrates an example of an external view of a speaker device 1 according to the present exemplary embodiment. FIG. 2 is a cross-sectional view taken along a line II-II of FIG. 1. FIG. 3A is an example of the cross-sectional structure diagram of the speaker device 1 according to the present exemplary embodiment. FIG. 3B is a detailed cross-sectional structure diagram of a first speaker unit 3 illustrated in FIG. 3A. As illustrated in FIGS. 1 and 2 and FIG. 3A, the speaker device 1 according to the first exemplary embodiment includes a cabinet 2 formed from a first cabinet 2*a* and a second cabinet 2*b*, a first speaker unit 3, a second speaker unit 4, and a joining member 5. The speaker device 1 reproduces an audio signal.

Cabinet

The cabinet 2 is formed from at least one cabinet. The cabinet 2 has the first speaker unit 3 and the second speaker unit 4 mounted therein so that the sound radiation directions are opposite to each other.

According to the present exemplary embodiment, the cabinet 2 is formed from a plurality of cabinets, that is, the first cabinet 2*a* and the second cabinet 2*b*. In addition, the first cabinet 2*a* has the first speaker unit 3 mounted therein. The second cabinet 2*b* has the second speaker unit 4 mounted therein. At least part of a space 51 formed between the first cabinet 2*a* and the second cabinet 2*b* (a space 51 formed by the first speaker unit 3 and the second speaker unit 4) communicates with the outside of the cabinet 2. Note that it is desirable that the first cabinet 2*a* and the second cabinet 2*b* have the same volume.

Joining Member

The joining member 5 mechanically joins the cabinets together. According to the present exemplary embodiment, the joining member 5 mechanically joins the first cabinet 2*a* and the second cabinet 2*b*.

In addition, the joining member 5 joins part of the circumference of the first cabinet 2*a* and part of the circumference of the second cabinet 2*b*. Accordingly, the space 51, which is formed between the first cabinet 2*a* and the second cabinet 2*b* and which does not contain the joining member 5, communicates with the outside of the cabinet 2.

First Speaker Unit

As described above, the first speaker unit 3 is attached to the upper portion of the cabinet 2, that is, the first cabinet 2*a*. According to the present exemplary embodiment, as illustrated in, for example, FIG. 3B, the first speaker unit 3 includes a first diaphragm 31, a first edge 32, a first magnetic circuit 33, a first voice coil bobbin 34, and a first voice coil 35. The first speaker unit 3 plays back a signal including a predetermined frequency band.

The first diaphragm 31 is disposed on the upper side of the first magnetic circuit 33 inside the cabinet 2 and is supported by the first edge 32 for vibration. In addition, the first diaphragm 31 has the first voice coil bobbin 34 fixed to the lower surface thereof.

The first edge 32 supports the first diaphragm 31 for vibration. In addition, the first edge 32 is disposed in the cabinet 2 so as to be convex upward. That is, the first edge 32 disposed on the upper side is convex upward. In other words, the first edge 32 is convex with respect to the space 51 in the cabinet 2 in a direction in which the first edge 32 is exposed into the outside. That is, the cross-sectional shape of the first edge 32 is convex from the space 51 to the first speaker unit 3.

The first magnetic circuit 33 includes, for example, a first magnetic circuit 33*a*. The first magnetic circuit 33 drives the first diaphragm 31. More specifically, the first magnetic circuit 33 is a circuit for generating a drive force that drives the first voice coil 35. As used herein, the term "external magnet-type magnetic circuit" refers to a magnetic circuit in which a magnet is disposed outside the voice coil, and the term "internal magnet-type magnetic circuit" refers to a magnetic circuit in which a magnet is disposed inside the voice coil. According to the present exemplary embodiment, as illustrated in FIG. 3B, the first magnetic circuit 33 has the first magnetic circuit 33*a* disposed inside the first voice coil 35. Thus, the first magnetic circuit 33 is an internal magnet-type magnetic circuit.

At least one first voice coil bobbin 34 is provided. The first voice coil bobbin 34 transfers vibration to the first diaphragm 31. More specifically, the first voice coil bobbin 34 supports the first diaphragm 31 and transfers vibration to the first diaphragm 31. The first voice coil 35 is formed by winding a wire around the outer circumferential surface of the substantially middle section of the first voice coil bobbin 34 in the height direction. The first voice coil 35 has the function of converting an audio current into vibration.

Second Speaker Unit

As described above, the second speaker unit 4 is attached to the lower portion of the cabinet 2, that is, the second cabinet 2*b*. According to the present exemplary embodiment, like the first speaker unit 3, the second speaker unit 4 includes a second diaphragm 41, a second edge 42, a second magnetic circuit 43, a second voice coil bobbin 44, and a second voice coil 45. The second speaker unit 4 generates a signal including a frequency band that is substantially the same as a predetermined frequency band played back by the first speaker unit 3.

The second diaphragm 41 is disposed in the cabinet 2 on the upper side of the second magnetic circuit 43. The second diaphragm 41 is supported by the second edge 42 for vibration. In addition, the second diaphragm 41 has the second voice coil bobbin 44 fixed to the lower surface thereof.

According to the present exemplary embodiment, the second diaphragm 41 is driven in a direction opposite that of the first diaphragm 31. That is, when the speaker device 1 reproduces an audio signal, the second diaphragm 41 and the first diaphragm 31 vibrate in opposite directions. That is, when the speaker device 1 reproduces an audio signal and if the first diaphragm 31 operates to move in a direction closer to the first magnetic circuit 33, the second diaphragm 41 operates to move in a direction away from the second magnetic circuit 43. If the first diaphragm 31 operates to move in a direction away from the first magnetic circuit 33, the second diaphragm 41 operates to move in a direction closer to the second magnetic circuit 43. For example, the negative polarity and positive polarity of an audio signal voltage are connected to the positive terminal and negative terminal of one of the first speaker unit 3 and the second speaker unit 4, respectively. The positive polarity and negative polarity of the audio signal voltage are connected to the positive terminal and negative terminal of the other of the first speaker unit 3 and the second speaker unit 4. In this manner, the first diaphragm 31 and the second diaphragm 41 can be vibrated in opposite directions when speaker device 1 reproduces an audio signal.

The second edge 42 supports the second diaphragm 41 for vibration. In addition, the second edge 42 is disposed in the cabinet 2 so as to be convex upward. That is, the second edge 42 disposed in the lower portion is convex upward. In other words, the second edge 42 is convex in a direction in which the second edge 42 enters the outside of the space 51 in the cabinet 2. That is, the cross-sectional shape of the second edge 42 is convex from the second speaker unit 4 toward the space 51.

The second magnetic circuit 43 includes, for example, a second magnetic 43*a*. The second magnetic circuit 43 vibrates the second diaphragm 41. More specifically, the second magnetic circuit 43 is a circuit for generating a drive force that drives the second voice coil 45. According to the present exemplary embodiment, the magnetization direction of the second magnet 43*a* and the magnetization direction of the first magnet 33*a* are opposite to each other. In addition, the second magnet 43*a* of the second magnetic circuit 43 is disposed inside of the second voice coil 45. Thus, like the first magnetic circuit 33, the second magnetic circuit 43 is an internal magnet-type magnetic circuit.

At least one second voice coil bobbin 44 is provided. The second voice coil bobbin 44 transfers vibration to the second diaphragm 41. More specifically, the second voice coil bobbin 44 supports the second diaphragm 41 and transfers vibration to the second diaphragm 41.

The second voice coil 45 is formed by winding a wire around the outer circumferential surface of the substantially middle section of the second voice coil bobbin 44 in the height direction. The second voice coil 45 converts an audio current into vibration. According to the present exemplary embodiment, the winding direction of the second voice coil 45 is opposite that of the first voice coil 35.

Advantages

As described above, according to the present exemplary embodiment, the speaker device 1 including a plurality of speaker units and capable of preventing a decrease in the quality of reproduced sound can be achieved. For example, according to the speaker device 1 of the present exemplary embodiment, the exits of the sounds can be combined into one exit by disposing the first speaker unit 3 and the second speaker unit 4 so that the first speaker unit 3 and the second speaker unit 4 are arranged in a stacked configuration. In this manner, acoustic radiation (playback) from a sound source similar to a point sound source can be provided. As a result, the speaker device 1 having excellent auditory lateralization can be achieved when stereophonic sound or multi-channel sound is played back.

More specifically, when an audio signal to be reproduced is applied to the speaker device 1, the audio signal is reproduced by each of the first speaker unit 3 and the second speaker unit 4. At that time, when the first diaphragm 31 in the speaker device 1 is displaced upward (the upward direction in FIG. 3A), the second diaphragm 41 is driven downward (the downward direction in FIG. 3A). In contrast, when the first diaphragm 31 is displaced downward, the second diaphragm 41 is driven so as to be displaced upward. In addition, these sounds are output from the space 51 to the space outside the cabinet 2 without a path length difference between the sounds. Thereafter, the sounds are combined in the space outside the cabinet 2 and are played back. That is, according to the speaker device 1 of the present exemplary embodiment, the path length difference between the sounds played back by the first speaker unit 3 and the second speaker unit 4 can be reduced and, thus, the phase interference can be prevented. As a result, a decrease in the quality of reproduced sound can be reduced.

In addition, for example, according to the speaker device 1 of the present exemplary embodiment, all the following disadvantages can be eliminated at the same time: the asymmetry between the volumes of air expelled by the edges of the first speaker unit 3 and the second speaker unit 4, distortion of the playback sound occurring due to the drive force of the diaphragm, and the vibration of the cabinet 2 caused by the vibrations of the speaker units 3 and 4.

More specifically, according to the speaker device 1 of the present exemplary embodiment, when an audio signal is reproduced by the speaker device 1, the first diaphragm 31 and the second diaphragm 41 are driven in opposite directions. Accordingly, the vibrations of the cabinet 2 caused by the vibrations of the first diaphragm 31 and the second diaphragm 41 are canceled out. Thus, the vibration of the cabinet 2 occurring when an audio signal is reproduced by the speaker device 1 can be significantly reduced.

In addition, according to the speaker device 1 of the present exemplary embodiment, for example, when an audio signal is reproduced by the speaker device 1 and if the first diaphragm 31 moves closer to the first magnetic circuit 33, the second diaphragm 41 is driven to move away from the second magnetic circuit 43. In addition, if the first diaphragm 31 moves away from the first magnetic circuit 33, the second diaphragm 41 is driven to move closer to the second magnetic circuit 43. As a result, the sum of the diaphragm drive forces of the first speaker unit 3 and the second speaker unit 4 is symmetrical with respect to a neutral point determined when no audio signal is applied to the speaker device 1. Thus, the asymmetry between the drive forces occurring in the first speaker unit 3 and the second speaker unit 4 can be canceled out. In this manner, distortion of the playback sound caused by the asymmetry between the drive forces can be significantly reduced.

In addition, according to the speaker device 1 of the present exemplary embodiment, for example, the first diaphragm 31 and the second diaphragm 41 are driven in opposite directions. Accordingly, the sum of the volumes of air expelled by the first edge 32 and the second edge 42 can be made symmetrical with respect to that when no audio signal is input and, thus, the displacement of each of the first diaphragm 31 and the second diaphragm 41 is zero. In this manner, the distortion of playback sound caused by the asymmetry between the volumes of air expelled by the first edge 32 and the second edge 42 can be significantly reduced.

While the above exemplary embodiment has been described with reference to the first speaker unit 3 and the second speaker unit 4 each including the internal magnet-type magnetic circuit illustrated in FIG. 3A, the type of the magnetic circuit is not limited thereto. For example, an external magnet-type magnetic circuit may be employed instead of the internal magnet-type magnetic circuit.

First Modification

Figure 4:
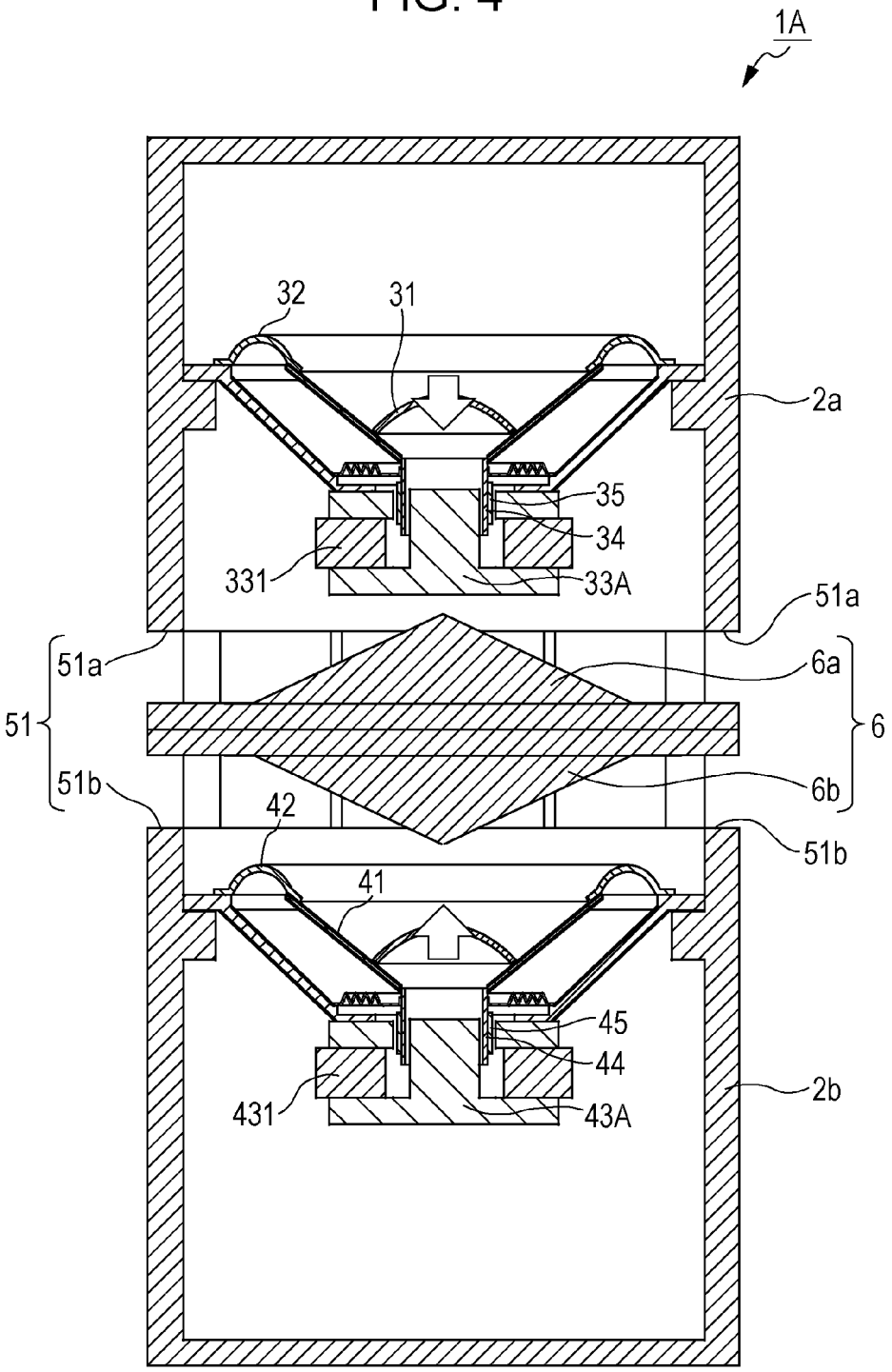
FIG. 4 illustrates an example of the cross-sectional structure of a speaker device according to a first modification of the first exemplary embodiment.

FIG. 4 illustrates an example of the cross-sectional structure of a speaker device 1A according to a first modification of the present exemplary embodiment. The same reference numerals are used in FIG. 4 to describe those constituent elements that are identical to the elements of FIG. 3A, and descriptions of the elements are not repeated. The speaker device 1A illustrated in FIG. 4 includes a first magnetic circuit 33A of the first speaker unit 3 and a second magnetic circuit 43A of the second speaker unit 4 having configurations that differ from those of the speaker device 1 illustrated in FIG. 3A. In addition, the speaker device 1A includes a reflective plate 6. The differences from the first exemplary embodiment are mainly described below.

Unlike the first magnetic circuit 33 illustrated in FIG. 3A which is an internal magnet-type magnetic circuit, the first magnetic circuit 33A has a first magnet 331 disposed outside the first voice coil 35. That is, the first magnetic circuit 33A is an external magnet-type magnetic circuit. Similarly, unlike the second magnetic circuit 43 illustrated in FIG. 3A which is an internal magnet-type magnetic circuit, the second magnetic circuit 43A has a second magnet 431 disposed outside the second voice coil 45. That is, the second magnetic circuit 43A is an external magnet-type magnetic circuit. The other configurations are the same as those of the first exemplary embodiment and, thus, descriptions of the configurations are not repeated.

The reflective plate 6 is disposed so as to face at least one of the first diaphragm 31 and the second diaphragm 41. The reflective plate 6 scatters the playback sound radiated from the speaker device 1A. According to the present exemplary embodiment, the reflective plate 6 is formed from a reflective plate 6*a* and a reflective plate 6*b*. The reflective plate 6*a* reflects the sound played back by the first speaker unit 3 in the horizontal direction. The reflective plate 6*b* reflects the sound played back by the second speaker unit 4 in the horizontal direction.

The speaker device 1A can efficiently radiate sound in the horizontal direction by using the reflective plate 6*a* and the reflective plate 6*b*. In addition, since as illustrated in FIG. 1, the cabinet 2 is tubular, the speaker device 1A can form an omnidirectional sound source having no horizontal directivity.

In addition, by using the reflective plate 6*a* and the reflective plate 6*b*, the speaker device 1A can reduce the capacity of the space 51 to the sum of the capacity of a space 51*a* surrounded by the reflective plate 6*a* and the first speaker unit 3 and the capacity of a space 51*b* surrounded by the reflective plate 6*b* and the second speaker unit 4. In this manner, the capacitor component that has an influence on the space 51*a*, the space 51*b*, and the resonance frequencies of the spaces 51*a* and 51*b* can be reduced. As a result, the quality of playback in the high frequency band can be increased more.

While the example illustrated in FIG. 4 has been described with reference to the configuration including the reflective plate 6*a* and the reflective plate 6*b*, a configuration including only one of the reflective plate 6*a* and the reflective plate 6*b* may be employed. In addition, the reflective plate 6*a* and the reflective plate 6*b* may be replaced with acoustic horns that increase the playback efficiency of the speaker device 1A.

Second Modification

Figure 5:
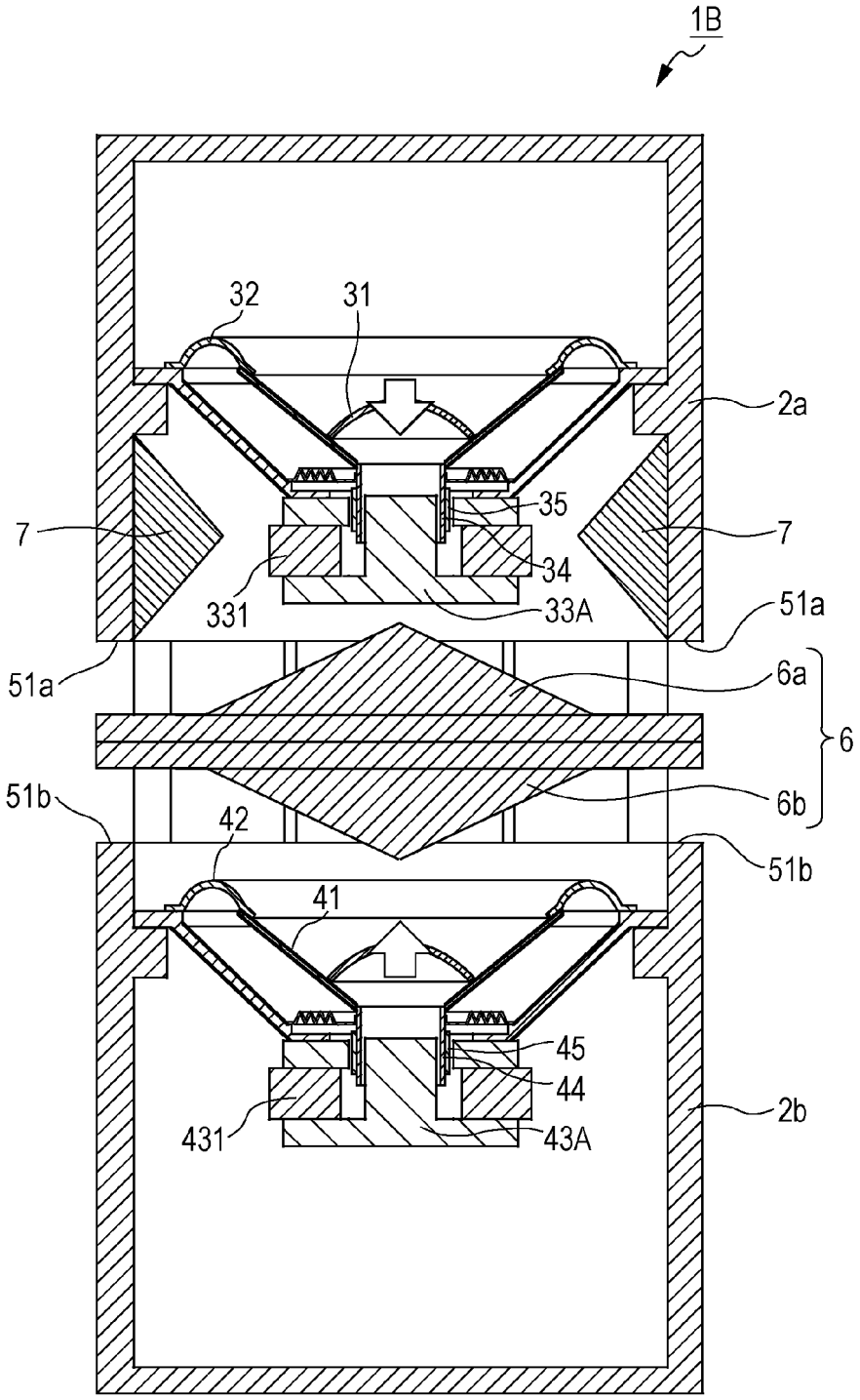
FIG. 5 illustrates an example of the cross-sectional structure of a speaker device according to a second modification of the first exemplary embodiment.

FIG. 5 illustrates an example of the cross-sectional structure of a speaker device 1B according to a second modification of the present exemplary embodiment. The same reference numerals are used in FIG. 5 to describe those constituent elements that are identical to the elements of FIG. 3A and FIG. 4, and descriptions of the elements are not repeated. The speaker device 1B illustrated in FIG. 5 includes a reflective plate 7 in addition to the configuration of the speaker device 1A illustrated in FIG. 4. The differences from the first modification are mainly described below.

The reflective plate 7 further reduces the capacity of the space 51*a* surrounded by the reflective plate 6*a* and the first speaker unit 3. In addition, the reflective plate 7 reflects the sound played back by the first speaker unit 3 in the vertical direction.

In this manner, the capacitor component that has an influence on the space 51*a*, the space 51*b*, and the resonance frequencies of the spaces 51*a* and 51*b* can be reduced. As a result, the quality of playback in the high frequency band can be increased more.

Third Modification

Figure 6:
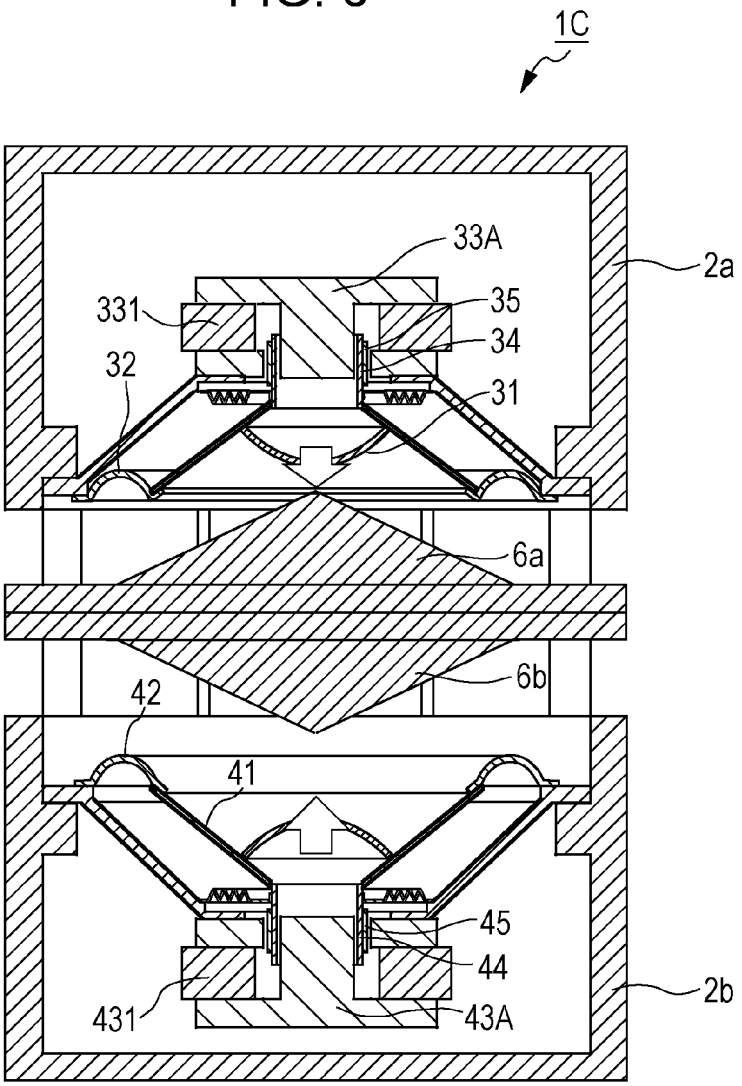
FIG. 6 illustrates an example of the cross-sectional structure of a speaker device according to a third modification of the first exemplary embodiment.

FIG. 6 illustrates an example of the cross-sectional structure of a speaker device 10 according to a third modification of the present exemplary embodiment. The same reference numerals are used in FIG. 6 to describe those constituent elements that are identical to the elements of FIG. 3A and FIG. 4, and descriptions of the elements are not repeated. The speaker device 10 illustrated in FIG. 6 has a different technique for mounting the first speaker unit 3, that is, different placement of the first speaker unit 3, from the speaker device 1A illustrated in FIG. 4. The differences from the second modification are mainly described below.

That is, as illustrated in FIG. 6, the first speaker unit 3 is mounted upside down (relative to FIG. 4). That is, the first speaker unit 3 may be placed so that the first diaphragm 31 and the reflective plate 6*a* face each other.

Although the asymmetry of the drive forces of the first diaphragm 31 and the second diaphragm 41 is not improved, the configuration can provide an effect of reducing the playback distortion caused by the symmetry of the sum of the volumes of air expelled by the first edge 32 and the second edge 42 and the vibration of the first cabinet 2*a*.

In addition, the configuration does not expose the first magnetic circuit 33A and the second magnetic circuit 43A to the outside of the cabinet 2. Accordingly, the configuration can prevent foreign particles from entering the first magnetic circuit 33A and the second magnetic circuit 43A.

Fourth Modification

Figure 7:
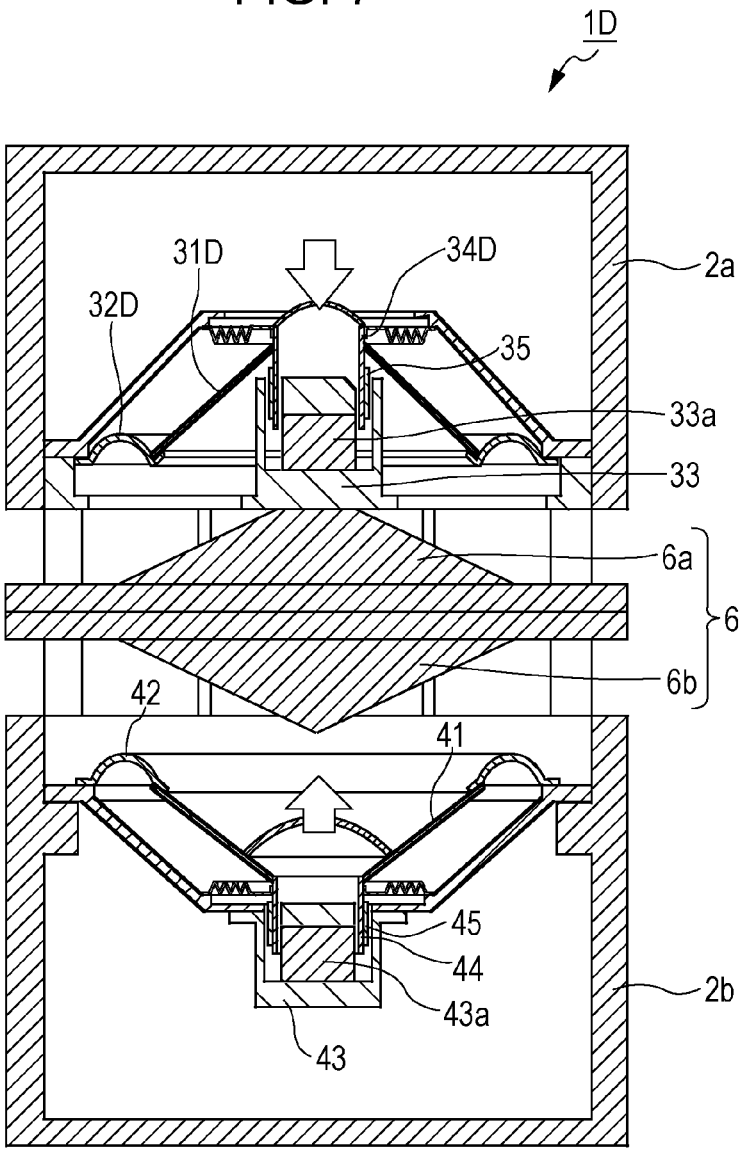
FIG. 7 illustrates an example of the cross-sectional structure of a speaker device according to a fourth modification of the first exemplary embodiment.

FIG. 7 illustrates an example of the cross-sectional structure of a speaker device 1D according to a fourth modification of the present exemplary embodiment. The same reference numerals are used in FIG. 7 to describe those constituent elements that are identical to the elements of FIG. 3A and FIGS. 4 and 6, and descriptions of the elements are not repeated. The speaker device 1D illustrated in FIG. 7 has the first speaker unit 3 and the second speaker unit 4 having configurations that differ from those of the speaker device 10 illustrated in FIG. 6. The differences from the third modification are mainly described below.

The first speaker unit 3 illustrated in FIG. 7 includes a first diaphragm 31D, a first edge 32D, a first magnetic circuit 33, and a first voice coil bobbin 34D having configurations that differ from those of the first speaker unit 3 illustrated in FIG. 6. That is, the first magnetic circuit 33 illustrated in FIG. 7 is an internal magnet-type magnetic circuit. The positions of the first diaphragm 31D, the first edge 32D, and the first voice coil bobbin 34D are opposite to those in the first magnetic circuit 33.

In addition, unlike the second speaker unit 4 illustrated in FIG. 6, the second speaker unit 4 illustrated in FIG. 7 has the second magnetic circuit 43 having a configuration of an internal magnet-type magnetic circuit.

Such a configuration can reduce the capacity of the space surrounded by the reflective plate 6*a* and the first speaker unit 3 (the area of the front surface of the reflective plate 6*a*). Thus, the speaker device 1D can more equally radiate sounds in the horizontal direction.

Second Exemplary Embodiment

Figure 8A:
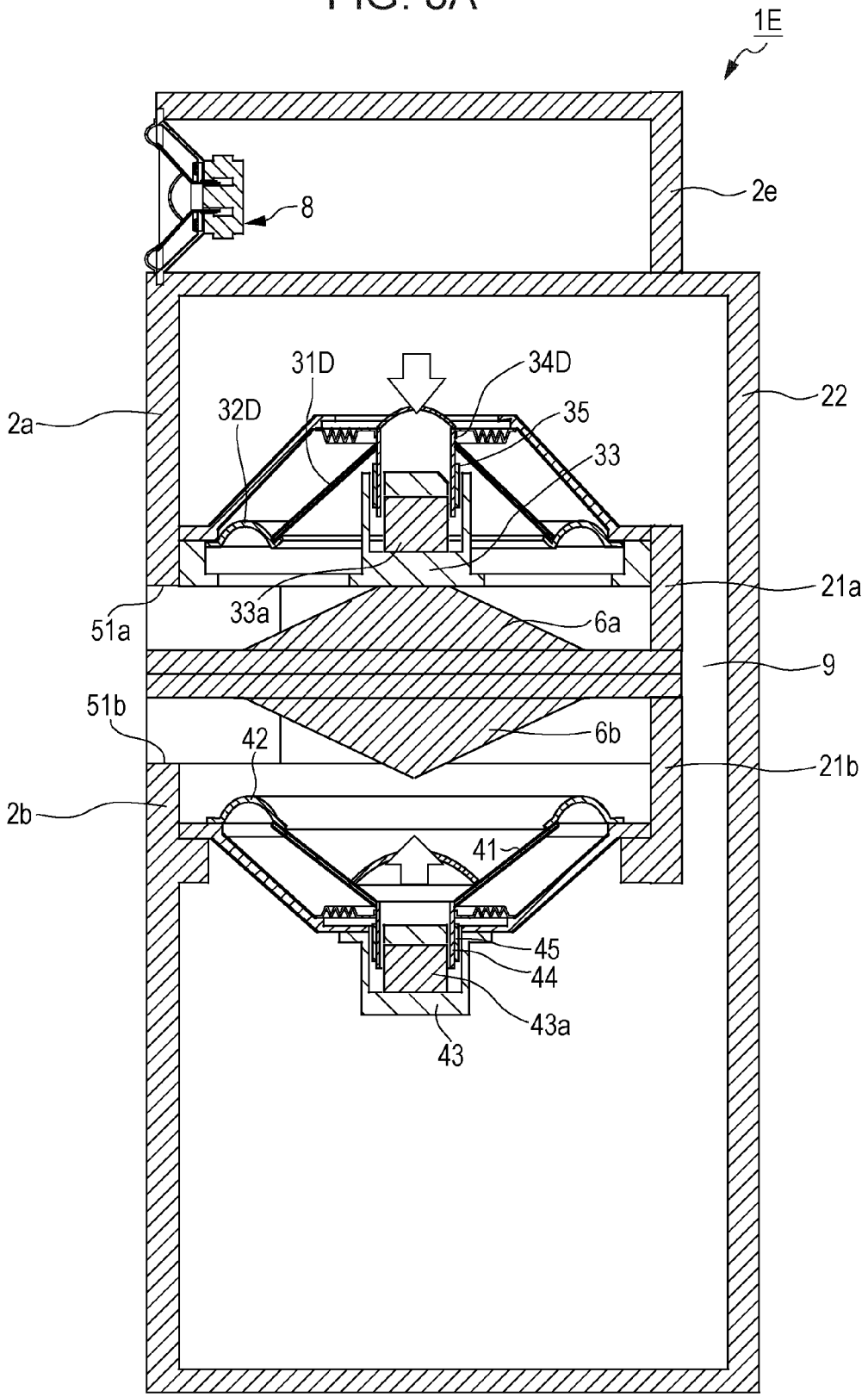
FIG. 8A illustrates an example of the cross-sectional structure of a speaker device according to a second exemplary embodiment.
Figure 8B:
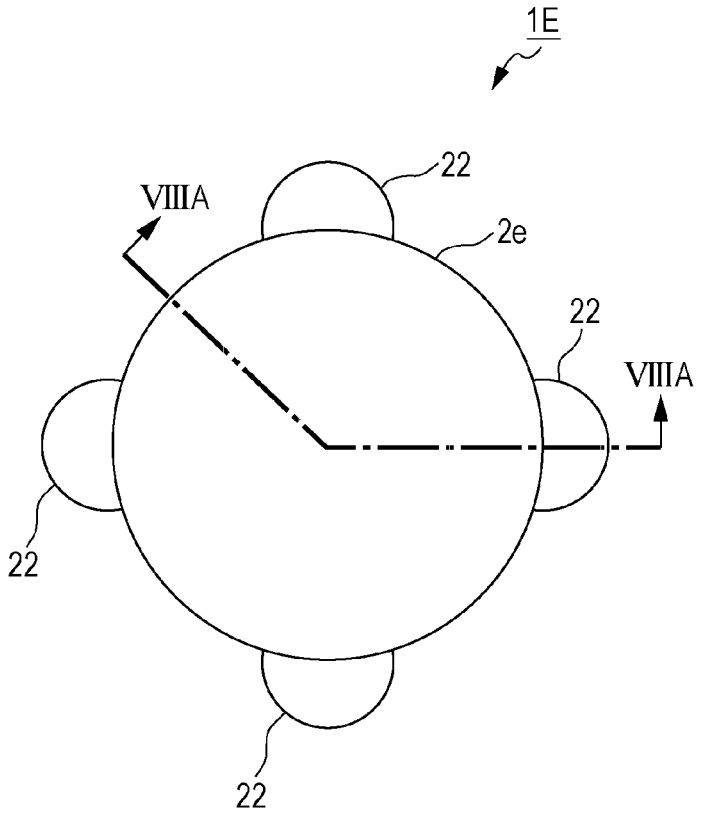
FIG. 8B is a schematic top view of the speaker device illustrated in FIG. 8A.

FIG. 8A illustrates an example of the cross-sectional structure of a speaker device 1E according to a second exemplary embodiment. FIG. 8B is a schematic top view of the speaker device 1E illustrated in FIG. 8A. FIG. 8A corresponds to a cross-sectional view taken along a line VIIIA-VIIIA of FIG. 8B. Note that the same reference numerals are used in FIG. 8A to describe those constituent elements that are identical to the elements of FIG. 7, and descriptions of the elements are not repeated.

Unlike the speaker device 1D illustrated in FIG. 7, the speaker device 1E illustrated in FIGS. 8A and 8B additionally includes a first cabinet portion 21*a*, a second cabinet portion 21*b*, a cabinet box 2*e*, a speaker unit 8, and a communication tube 9. The differences from the fourth modification are mainly described below.

The cabinet box 2*e* is disposed in the upper section of the speaker device 1E. The speaker unit 8 is mounted in the cabinet box 2*e*. The diameter of the cabinet box 2*e* is the same as the diameter of the cabinet 2, that is, the diameter of the first cabinet 2*a* and the second cabinet 2*b*.

The speaker unit 8 is a speaker unit that produces a high frequency sound, such as a tweeter. The speaker unit 8 is mounted so that the diaphragm thereof communicates with the outside of the cabinet box 2*e*.

The communication tube 9 has a hollow columnar shape that acoustically connects a plurality of cabinets to one another. According to the present exemplary embodiment, the communication tube 9 is formed from the first cabinet portion 21*a* of the first cabinet 2*a* having an opening, the second cabinet portion 21*b* of the second cabinet 2*b* having an opening, and a third cabinet portion 22. The communication tube 9 acoustically connects the first cabinet 2*a* to the second cabinet 2*b*.

The configuration allows the capacity of the first cabinet 2*a* and the capacity of the second cabinet 2*b* to be shared without combining the capacity of the first cabinet 2*a* and the capacity of the second cabinet 2*b*. Thus, the capacitor components that have an influence on the resonance frequency are the same. As a result, distorted sound from the first speaker unit 3 and the second speaker unit 4 can be effectively reduced.

Modification

Figure 9A:
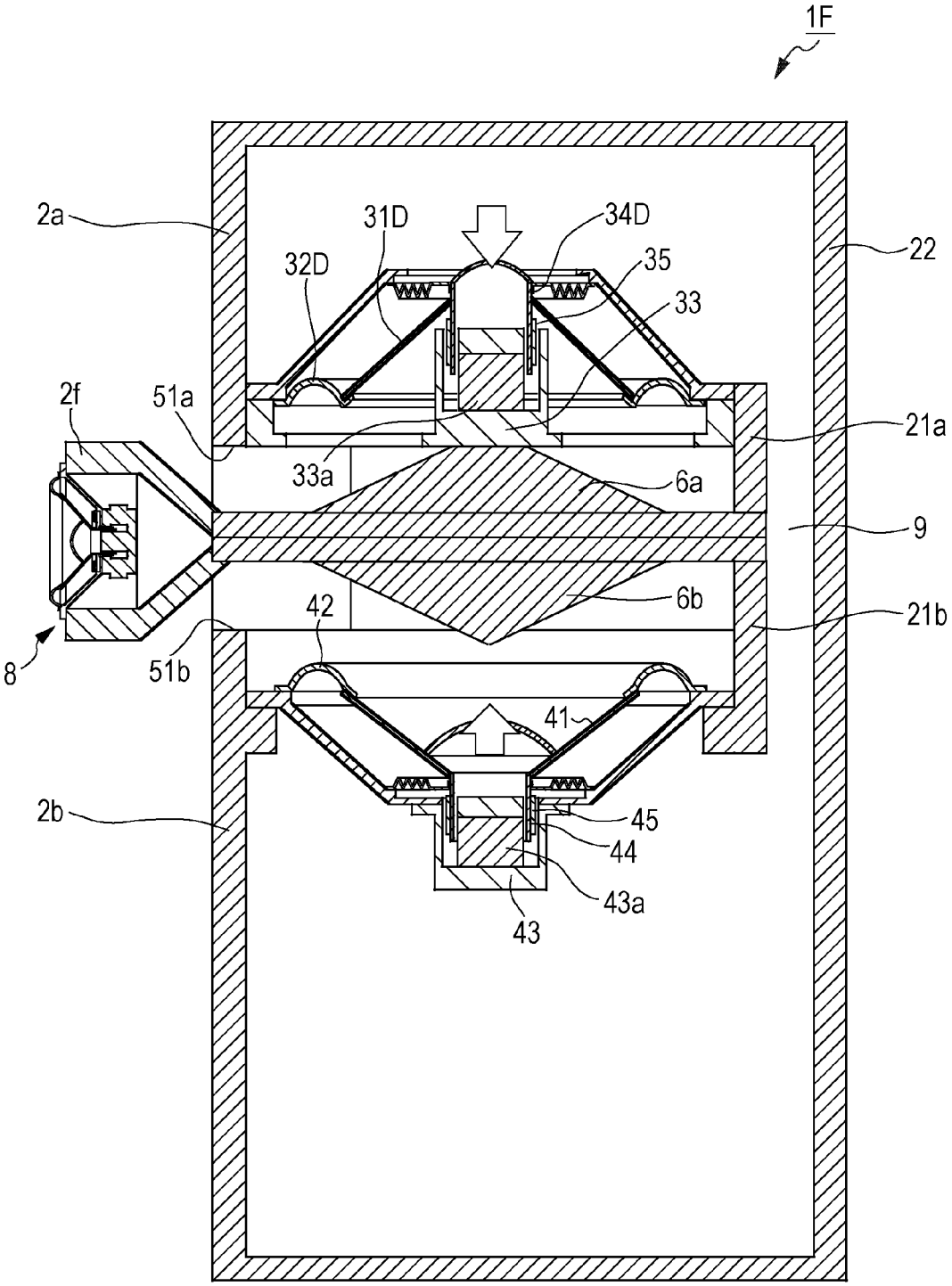
FIG. 9A illustrates an example of the cross-sectional structure of a speaker device according to a modification of the second exemplary embodiment.
Figure 9B:
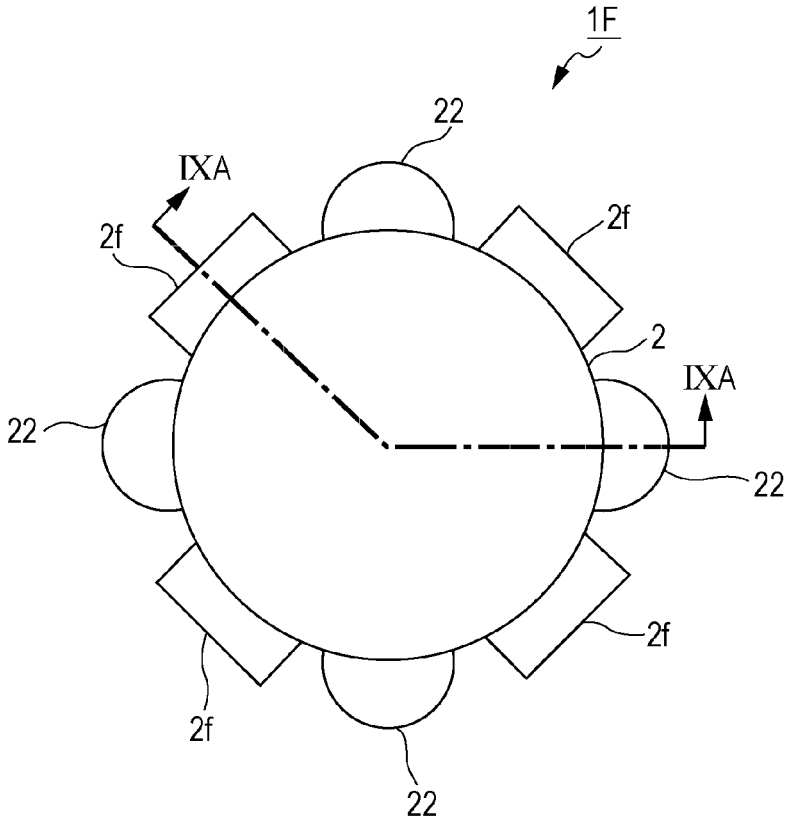
FIG. 9B is a schematic top view of the speaker device illustrated in FIG. 9A.
Figure 10:
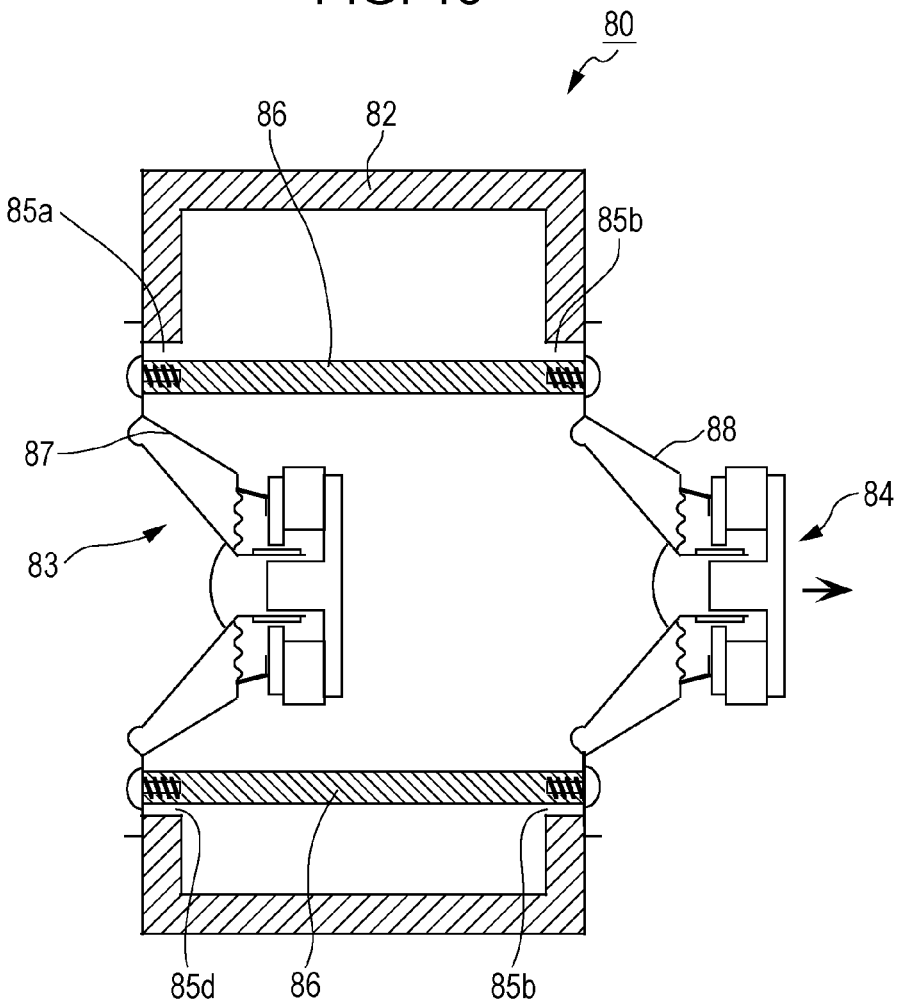
FIG. 10 illustrates the configuration of an existing speaker device.

FIG. 9A illustrates an example of the cross-sectional structure of a speaker device 1F according to a modification of the second exemplary embodiment. FIG. 9B is a schematic top view of the speaker device 1F illustrated in FIG. 9A. FIG. 9A corresponds to a cross-sectional view taken along a line IXA-IXA of FIG. 9B. The same reference numerals are used in FIGS. 9A and 9B to describe those constituent elements that are identical to the elements of FIG. 7, and descriptions of the elements are not repeated.

The speaker device 1F illustrated in FIGS. 9A and 9B has a cabinet box 2*f* having a configuration that differs from the speaker device 1E illustrated in FIGS. 8A and 8B. The differences from the second exemplary embodiment are mainly described below.

The cabinet box 2*f* is disposed in the vicinity of the spaces 51*a* and 51*b* of the speaker device 1F so as not to close the spaces 51*a* and 51*b*. In addition, the cabinet box 2*f* has the speaker unit 8 mounted therein so that the diaphragm of the speaker unit 8 communicates with the outside of the cabinet box 2*f*.

In the configuration, the speaker unit 8 that produces high frequency sound is located in the vicinity of the first speaker unit 3 and the second speaker unit 4. Accordingly, the sounds output from these speakers are combined in a space outside the spaces 51*a* and 51*b* and are played back. In this manner, according to the present exemplary embodiment, the path length differences among the sounds produced by the first speaker unit 3, the second speaker unit 4, and the speaker unit 8 can be made small.

As described above, according to the speaker device 1F of the present modification, unlike the layout in which the first speaker unit 3, the second speaker unit 4, and the speaker unit 8 are disposed far from one another and, thus, the path length differences among the playback sounds are generated, the quality of the playback sound can be increased more.

While the speaker devices according to the present disclosure have been described with reference to the exemplary embodiments, the present disclosure is not limited thereto. A variety of modifications of the exemplary embodiments that are conceivable by those skilled in the art and an embodiment configured by combining constituent elements of different embodiments can be encompassed in the scope of the present disclosure.

For example, while the above-described exemplary embodiments have been described with reference to the space 51 formed between the first cabinet 2*a* and the second cabinet 2*b* and allowed to communicate with the outside of the cabinet 2 by connecting the first cabinets 2*a* and the second cabinet 2*b* forming the cabinet 2 to each other using the joining member 5, the configuration is not limited thereto. The first cabinet 2*a* may be connected to the second cabinet 2*b*, and at least one opening may be provided at a position corresponding to the space 51.

Alternatively, each of the first cabinet 2*a* and the second cabinet 2*b* that form the cabinet 2 may have an acoustic port (i.e., a bass reflex system), so that the bass sound playback performance may be enhanced. As described in the second exemplary embodiment, when the speaker device includes a communication tube, one of the first cabinet 2*a* and the second cabinet 2*b* may have an acoustic port. The communication tube provides an effect that is the same as the effect provided when each of the first cabinet 2*a* and the second cabinet 2*b* has the acoustic port. Note that the speaker device according to the present disclosure may have any speaker cabinet structure, such as a back-loaded horn system, in addition to the bass reflex system.

In addition, the speaker device according to the present disclosure may be included, as a high quality speaker having low sound distortion, in audio and visual (AV) equipment (e.g., audio equipment and a television set), mobile devices (e.g., a laptop computer), speaker systems of a vehicle (e.g., an automobile), and active noise canceller (ANC) speaker systems. In such a case, a high quality speaker including a cabinet and a plurality of speaker units and having a low playback sound distortion can be provided.

The present disclosure is applicable to AV equipment (e.g., audio equipment and a television set), mobile devices (e.g., a laptop computer), speaker systems of a vehicle (e.g., an automobile), and active noise canceller (ANC) speaker systems.

What is claimed is:

1. A speaker device for reproducing an audio signal, the speaker device comprising:

a first speaker including a first diaphragm and a first magnetic circuit that drives the first diaphragm, the first diaphragm reproducing an audio signal including a predetermined frequency range;

a second speaker including a second diaphragm and a second magnetic circuit that drives the second diaphragm, the second diaphragm reproducing an audio signal including a frequency range substantially the same as the predetermined frequency range; and at least one housing having the first speaker and the second speaker mounted therein, the speakers being mounted such that sounds from the first and second speakers are radiated in directions opposite to each other, wherein at least part of a space provided between the first speaker and the second speaker communicates with an outside of the housing, wherein, the first magnetic circuit is located between the first diaphragm and the second diaphragm, the second diaphragm is located between the first magnetic circuit and the second magnetic circuit, and wherein, when the audio signal is reproduced by the speaker device and when the first diaphragm moves closer to the first magnetic circuit, the second diaphragm moves away from the second magnetic circuit, and when the first diaphragm moves away from the first magnetic circuit, the second diaphragm moves closer to the second magnetic circuit.

2. The speaker device according to claim 1, wherein the first speaker includes a first edge that supports the first diaphragm for vibration, and the second speaker includes a second edge that supports the second diaphragm for vibration, wherein a cross-sectional shape of the first edge is convex in a direction from the space toward the first speaker, and a cross-sectional shape of the second edge is convex in a direction from the second speaker toward the space.

3. The speaker device according to claim 1, further comprising:

a diffuser plate that is located in the space at a position facing at least one of the first diaphragm and the second diaphragm, the diffuser plate scattering playback sound output from the speaker device.

4. The speaker device according to claim 1, wherein the housing comprises a plurality of housings, and the plurality of housings are mechanically joined together.

5. The speaker device according to claim 4, further comprising:

a communication tube that acoustically joins the plurality of housings together.

6. The speaker device according to claim 1, wherein, when the audio signal is reproduced by the speaker device, the first diaphragm and the second diaphragm vibrate in opposite directions by connecting a negative polarity and a positive polarity of an audio signal voltage to a positive terminal and a negative terminal of one of the first speaker and the second speaker, respectively, and connecting the positive polarity and the negative polarity of the audio signal voltage to a positive terminal and a negative terminal of the other of the first speaker and the second speaker, respectively.

7. The speaker device according to claim 1, wherein the first speaker includes at least one first voice coil bobbin and a first voice coil comprising a winding of a wire around an outer circumferential surface of a substantially middle portion of the first voice coil bobbin in a height direction to transfer vibration to the first diaphragm, wherein the second speaker includes at least one second voice coil bobbin and a second voice coil comprising a winding of a wire around an outer circumferential surface of a substantially middle portion of the second voice coil bobbin in a height direction to transfer vibration to the second diaphragm, and wherein winding directions of the first voice coil and the second voice coil are opposite to each other.

8. The speaker device according to claim 1, wherein the first magnetic circuit includes a first magnet, and the second magnetic circuit includes a second magnet, and wherein magnetization directions of the first magnet and the second magnet are opposite to each other.

9. A vehicle comprising:

the speaker device according to claim 1.

10. An audio and visual (AV) equipment comprising: the speaker device according to claim 1.

* * * * *